US008834721B2

(12) United States Patent
Martin et al.

(10) Patent No.: US 8,834,721 B2
(45) Date of Patent: Sep. 16, 2014

(54) MAGNETIC FILTRATION APPARATUS

(75) Inventors: Kevin Martin, Rotherham (GB); Keith Newman, Chesterfield (GB); Steve Mcallorum, Doncaster (GB)

(73) Assignee: Eclipse Magnetics Limited, South Yorkshire (GB)

( * ) Notice: Subject to any disclaimer, the term of this patent is extended or adjusted under 35 U.S.C. 154(b) by 544 days.

(21) Appl. No.: 13/059,117

(22) PCT Filed: Jan. 10, 2011

(86) PCT No.: PCT/GB2011/050029

§ 371 (c)(1),
(2), (4) Date: Jul. 28, 2011

(87) PCT Pub. No.: WO2011/086370

PCT Pub. Date: Jul. 21, 2011

(65) Prior Publication Data

US 2012/0175312 A1 Jul. 12, 2012

(51) Int. Cl.
*B03C 1/033* (2006.01)
*B03C 1/28* (2006.01)

(52) U.S. Cl.
CPC ..... *B03C 1/286* (2013.01); *B03C 2201/18* (2013.01); *B03C 2201/28* (2013.01); *B03C 1/0332* (2013.01)
USPC ..... 210/695; 210/222; 209/223.2; 209/232

(58) Field of Classification Search
CPC .. B03C 1/286; B03C 1/0332; B03C 2201/18; B03C 2201/28
USPC ..... 210/695, 222; 209/223.2, 232
See application file for complete search history.

(56) References Cited

U.S. PATENT DOCUMENTS

| | | | | |
|---|---|---|---|---|
| 4,251,372 | A | 2/1981 | Dolle | |
| 4,519,906 | A | 5/1985 | Hikosaka et al. | |
| 5,089,129 | A | 2/1992 | Brigman | |
| 7,073,668 | B2 * | 7/2006 | Alford et al. | 209/216 |
| 2004/0182769 | A1 | 9/2004 | Fogel et al. | |
| 2008/0073268 | A1 | 3/2008 | Cort | |

FOREIGN PATENT DOCUMENTS

| | | | |
|---|---|---|---|
| EP | 0501033 | A1 | 9/1992 |
| EP | 2174718 | A2 | 4/2010 |
| GB | 2423947 | A | 9/2006 |
| JP | 59095913 | A | 6/1984 |
| WO | 2009137710 | A2 | 11/2009 |

OTHER PUBLICATIONS

International Preliminary Report on Patentability for PCT/GB2011/050029, dated Jul. 17, 2012.*
International Search Report, Application No. GB1000364.8, May 12, 2010, 1 page.
International Search Report, Application No. PCT/GB2011/050029, Mar. 11, 2011, 4 pages.

* cited by examiner

*Primary Examiner* — David A Reifsnyder
(74) *Attorney, Agent, or Firm* — Howard & Howard Attorney's PLLC

(57) ABSTRACT

A magnetic filtration apparatus to separate ferrous contaminant material from a working fluid. The separation apparatus has a housing that is divided into a plurality of filtration chambers, each chamber having an elongate magnetic core to generate a magnetic field to entrap the contaminant material as it flows through the filter body. A fluid communication passageway is provided between the first and second chambers and is positioned such that the fluid exposure to the magnetic fields is maximized.

25 Claims, 5 Drawing Sheets

MAGNETIC FILTRATION APPARATUS

The subject patent application claims priority to and all the benefits of International Application No. PCT/GB2011/050029, filed on Jan. 10, 2011 with the World Intellectual Property Organization, the discloser of which is hereby incorporated by reference, which in turn claims priority to United Kingdom Patent Application No. 1000364.8, filed on Jan. 12, 2010 with the UK Patent Office.

The present invention relates to magnetic filtration apparatus configured to separate contaminant material from a working fluid and in particular, although not exclusively, to filtration apparatus having a plurality of separation chambers, with each chamber having a magnetic core to entrap the contaminant material.

Industrial applications that utilise a working fluid to provide cooling, lubrication or to remove wear debris from machine processing tools and products, employ fluid filtration devices to extract particulate matter from the fluid. The cleaned fluid may then be re-circulated for further use or more readily disposed of due to the removal of the particulate matter. Without filtration devices, the working fluid would quickly become heavily contaminated resulting in machine wear and/or failure. Also, in most territories, the filtering and cleaning of industrial fluid waste is required prior to discarding.

A number of magnetic based filtration devices have been proposed, configured to filter magnetic particles from fluids in particular, liquids. Such units may be employed in an on-line capacity, forming part of the fluid circuit during operation of the machinery or production line, or in an off-line state in which the working fluid is diverted or isolated from the production line when inoperative to provide the required filtration.

GB 1192870, US 2007/0090055 and WO 2005/061390 disclose cartridge based magnetic separators. Fluid, flowing through the cartridge passes over a magnet which entraps the ferrous particles within its magnetic field. Clean, filtered liquid then flows out of the cartridge. GB 2459289 discloses magnetic filtration apparatus that utilises a carousel assembly mounting a plurality of filter cartridges between operative filtration positions and at least one cleaning position. An automated cleaning mechanism is provided to dislodge deposited ferrous material from entrapment by the magnetic field as part of the filtration cycle. The removal of deposited contaminant material is a necessity to avoid saturation of the filter and ultimately blockage of the fluid flow path and termination of the working fluid flow cycle which in turn would terminate the manufacturing process being reliant upon the working fluid.

Whilst magnetic filtration devices are advantages over conventional paper or magnetic based filters a number of problems exist. For example, cleaning of the magnets to remove deposited ferrous material remains problematic. In particular, conventional magnetic filters are typically difficult to maintain and repair due to their intricate and complex construction that relies on sealing gaskets, o-rings and the like to provide a fluid tight seal at a large number of junctions. Incorrect alignment of such seals causes fluid leakage from the system necessitating complete system shutdown whilst the filter is repaired.

Also, conventional magnetic filtration devices are typically limited in their operation time between the necessary cleaning/purging operations to remove deposited contaminant materials. Furthermore, the period length required to remove the ferrous material (the downtime of the filter) is unsatisfactory when the filter is implemented in-line as part of the working fluid cycle.

Moreover, where the cleaning of deposited ferrous material from the filter is automated, it is known to use pneumatic or hydraulic actuating mechanisms to provide the purge action. Such cleaning processes are typically inefficient with regard to the level of consumption and pressure required of the compressed air or liquid to drive the mechanical actuators.

What is required is a magnetic filtration device that addresses the above problems.

The inventors provide a magnetic filtration apparatus that filters a contaminated working fluid efficiently so as to increase the working cycle of the filter and to minimise the time period taken for purging of the device between operation cycles and to avoid complete saturation. The present apparatus comprises a multi-chamber housing in which internal fluid flow is directed along at least two flow paths through the device, each flow path passing over the full length of an elongate magnetic core according to a pre-filtration and a final filtration treatment. The apparatus also provides a change in the rate of flow through the different sub-channels so as to optimise filtration and purging efficiency. Furthermore, automisation of the purging cycle is provided via suitable actuation and control means to minimise disruption to the fluid flow cycle forming part of a manufacturing process in which the working fluid is an integral part. Finally, the present filter comprises a simplified construction to reduce the number of sealing gaskets, o-rings and the like so as to minimise maintenance and greatly facilitate efficient cleaning and repair as required.

Finally, the present filtration apparatus utilises a common actuation mechanism to displace the magnetic cores enabling a compact construction which is desirable for installation of the filter within a fluid flow network. Furthermore, stability and reliability of movement of the magnetic cores is provided by the common actuator.

According to a first aspect of the present invention there is provided magnetic filtration apparatus to separate contaminant material from a fluid, said apparatus comprising: a housing to provide containment of a fluid flowing through the apparatus, the housing having a fluid inlet and a fluid outlet; a first elongate chamber within the housing, the first chamber in fluid communication with the inlet to allow fluid to enter the first chamber substantially towards a first end; a first elongate magnetic core extending axially within the first elongate chamber such that a magnetic field generated by the magnetic core is created in the fluid flow path to entrap contaminant material as it flows passed the first magnetic core; a second elongate chamber within the housing, the second chamber in fluid communication with the outlet to allow the fluid to exit the second chamber substantially towards a first end; a second elongate magnetic core extending axially within the second elongate chamber such that a magnetic field generated by the magnetic core is created in the fluid flow path to entrap contaminant material as it flows passed the second magnetic core; a passageway connecting the first and second elongate chambers in internal fluid communication towards their respective second ends such that the fluid is directed to flow from the inlet passed substantially the full length of the first magnetic core in a first direction, through the passageway, passed substantially the full length of the second magnetic core in a second direction opposed to the first direction to the outlet.

Preferably, the actuation mechanism comprises a piston, a cylinder and a drive rod connected to the piston. According to one embodiment, the actuation mechanism comprises a fluid flow inlet and outlet at the piston side of the cylinder such that fluid flowing into the cylinder via said inlet is configured to push the cylinder and the drive rod axially along the length of the cylinder. Preferably, the actuation mechanism comprises means to allow pneumatic actuation. Preferably, each magnetic core is connected to the drive rod such that as the drive rod is pushed along the length of the cylinder, each magnetic core is withdrawn from their respective tubes.

Preferably, the first and second chambers are defined by partition walls extending internally within the housing. Preferably, the passageway is defined by a gap in the partition wall separating the first and second chambers, the gap positioned towards each second end of the first and second chambers. Optionally, the first and second chambers and the passageway are sized such that a fluid flow speed in the first chamber is at least double the fluid flow speed in the second chamber.

Preferably, the filtration apparatus further comprises electronic control means coupled to the actuation mechanism to control displacement of the magnetic cores relative to each chamber. Preferably, the filter further comprises at least one contaminant saturation sensor to monitor the amount of contaminant material entrapped by the first and second magnetic cores.

Optionally, the filter comprises one magnetic core positioned within the first chamber and two magnetic cores positioned within the second chamber. Alternatively, the filter may comprise two magnetic cores positioned within the first chamber and four magnetic cores positioned within the second chamber. According to further embodiments, the first chamber and the second chamber may comprise a plurality of cores where the number of cores in the second chamber is double the number of cores in the first chamber.

According to a specific implementation when orientated in normal use the direction of the fluid flow passed the first magnetic core in the first chamber is opposed to gravity and the direction of the fluid flow in the second chamber passed the second magnetic core is in the same direction as the gravitational force.

According to a second aspect of the present invention there is provided a method of separating contaminant from a fluid using magnetic filtration apparatus, the method comprising: passing a fluid for filtration through a housing having an inlet and an outlet; directing the fluid to flow lengthwise through a first elongate chamber within the housing from the inlet positioned towards one end of the first chamber; the fluid flowing through a magnetic field created within the first chamber by an elongate first magnetic core extending axially within the first chamber, the magnetic field acting to entrap contaminant material from the fluid; directing the fluid to flow lengthwise through a second elongate chamber within the housing to the outlet positioned towards one end of the second chamber; the fluid flowing through a magnetic field created within the second chamber by a second elongate magnetic core extending axially within the second chamber, the magnetic field acting to entrap contaminant material from the fluid; directing the fluid through a passageway connecting the first and second chambers in internal fluid communication at the respective second ends such that the fluid flows from the inlet passed substantially the full length of the first magnetic core in a first direction, through the passageway, passed substantially the full length of the second magnetic core in a second direction opposed to the first direction to the outlet.

The filtration method comprises a purging cycle that is configured to punctuate the operation cycle. The purging cycle comprises withdrawing the elongate magnetic cores axially from the respective first and second chambers using an actuation mechanism. Optionally, the actuation mechanism comprises a piston, a cylinder and a drive rod connected to the piston. The purging cycle further comprises removing deposited contaminant material from around each of the elongate magnetic cores by allowing fluid to flow through the first and second chambers with the first and second magnetic cores withdrawn from the first and second chambers. Optionally, the purging cycle further comprises diverting fluid flow downstream of the apparatus to collect contaminant material washed from around the magnetic cores. Finally, the purging cycle comprises reintroducing the first and second magnetic cores into the respective first and second chambers using the actuation mechanism.

Preferably, control and transition between the operation and purging cycles is controlled by suitable electronic and/or mechanical control. Preferably, when controlled electronically via a suitable electronic control means, the method comprises automating withdrawal of the first and second magnetic cores from the respective first and second chambers and reintroducing the first and second magnetic cores at the first and second chambers using a control means. Preferably, the control means is a programmable logic controller. Alternatively, the control means may be software running on a PC.

A specific implementation of the present invention will now be described, by way of example only and with reference to the accompanying drawings in which.

Figure 1:
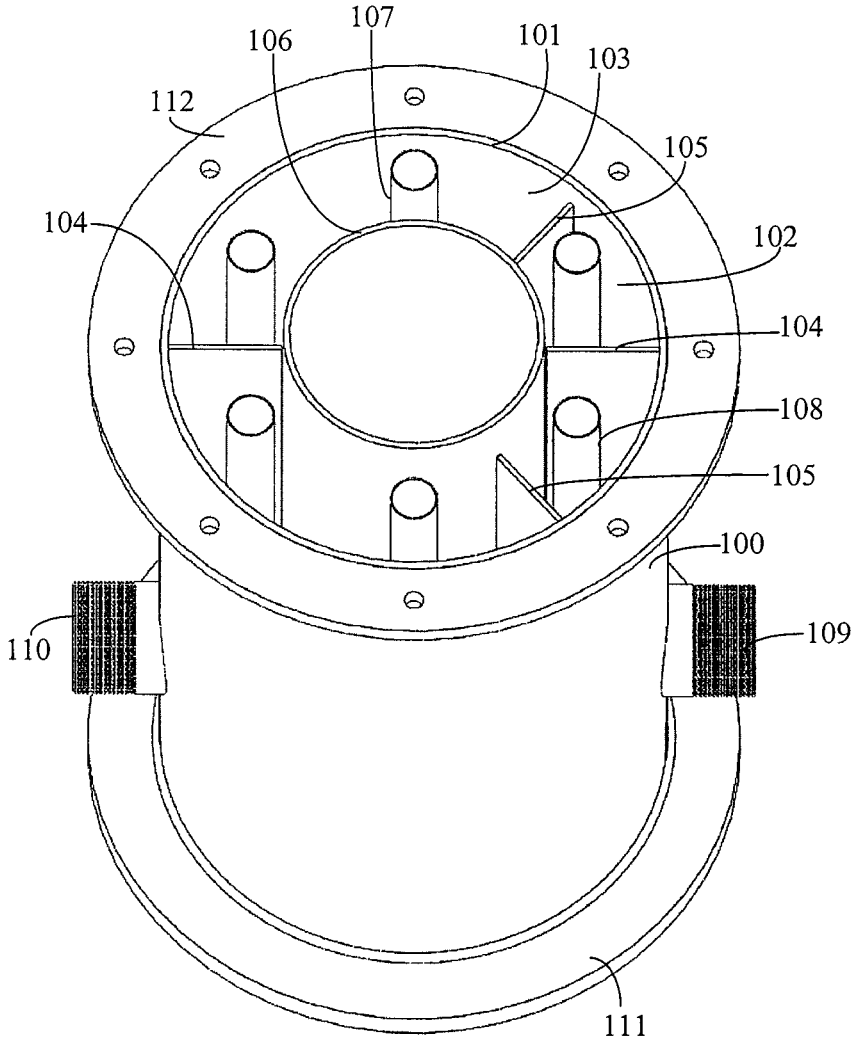
FIG. 1 is a perspective view of a part of the magnetic filtration apparatus in which a plurality of elongate magnetic cores are positioned within a housing partitioned into a plurality of internal fluid flow chambers according to a specific implementation of the present invention.

Referring to FIG. 1 the filtration apparatus comprises a housing 100 having an inlet 109 and an outlet 110. The housing 100, according to the specific implementation, is cylindrical with inlet 109 and outlet 110 positioned towards one end of the cylindrical walls in close proximity to a base 111.

The walls of the cylindrical housing 100 define an internal chamber 101 partitioned into a plurality of sub-chambers surrounding a central cylinder 106 extending axially within the main chamber 101 along the length of the cylindrical housing 100. Internal chamber 101 is firstly divided into two internal chambers by elongate partition walls 104 extending longitudinally between the internal surface of the housing walls 100 and the outer facing surface of central cylinder 106. The two sub-chambers are divided further into a first chamber 102 and a second chamber 103 by internal partition walls 105 extending longitudinally between the internal surface of the housing walls 100 and the outer facing surface of inner cylinder 106. That is, partition walls 104 and 105 extend radially from central cylinder 106 and substantially the full length of the elongate cylindrical chamber 101.

Partition walls 105 are positioned such that the volume of the first chamber 102 is less than the volume of second chamber 103. In particular, the volume of first chamber 102 is approximately half that of second chamber 103 according to the specific implementation.

An elongate magnetic core 108 is positioned within each first chamber 102 and extends axially substantially the full length of cylindrical housing 100 within internal chamber 101. Similarly, two elongate magnetic cores 107 are positioned within the second chamber 102 and extend axially along the length of cylindrical housing 100 within main internal chamber 101. According to the specific implementation, the filtration apparatus comprises two first chambers 102, two second chambers 103, with each first chamber 102 comprising a single elongate magnetic core whilst each second chamber 103 comprises two elongate magnetic cores 107. According to a further implementation, the filtration apparatus may comprise two elongate magnetic cores 108 positioned within each of the first chambers 102 and four elongate magnetic cores 107 positioned within each of the second chambers 103.

Figure 3:
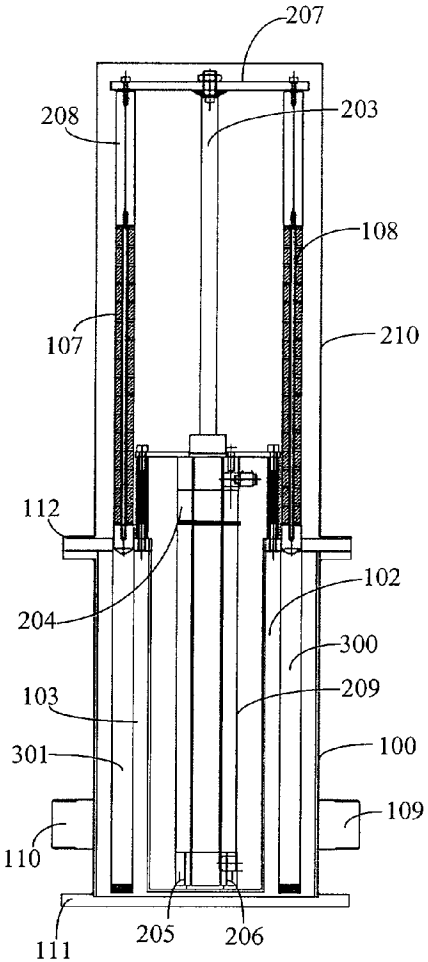
FIG. 3 is a cross sectional side elevation view of the filtration apparatus of FIG. 1 with the elongate magnetic cores orientated in an cleaning/purge position to allow contaminant material to be cleaned from the filter.
Figure 2:
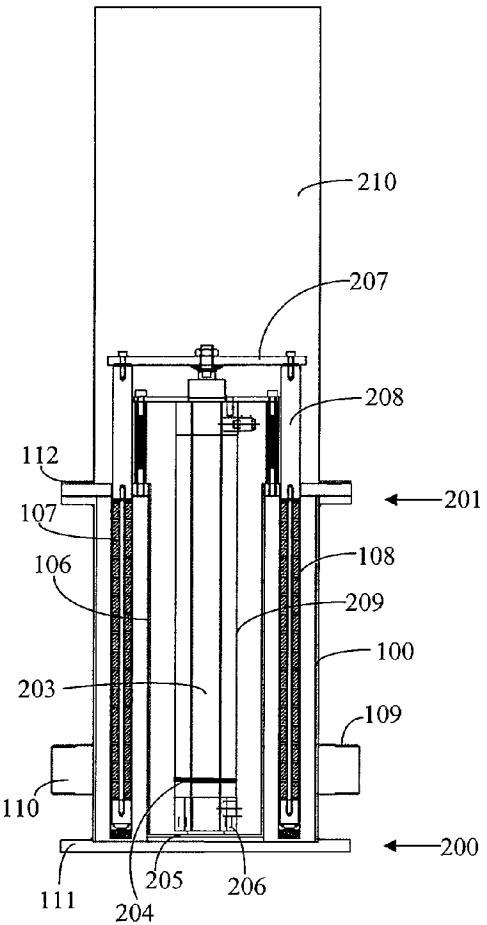
FIG. 2 is a cross sectional side elevation view of the filtration apparatus of FIG. 1 with the elongate magnetic cores orientated in an operation position to filter a working fluid.

Referring to FIGS. 2 and 3 an upper elongate cylindrical housing 210 is connected to the main housing 100 via an annular collar 112 positioned at an upper end 201 of cylindrical housing 100. Inlet 109 and outlet 110 are positioned at an opposite bottom end 200 of housing 100. Each of the elongate magnetic cores 108, 107 are housed within respective elongate tubes 300, 301 extending axially within the respective first and second chambers 102, 103 between the upper end 201 and bottom end 200 of housing 100. Tubes 300, 301 are dimensioned so as to accommodate the rod-like cylindrical magnetic cores 108, 107. A small gap is provided between the inner facing surface of tubes 300, 301 and the external surface of the cylindrical magnetic cores 108, 107 so as to allow each column of magnets to be inserted and withdrawn from their respective housing tubes 300, 301.

A mechanical actuator is housed within the filtration apparatus and is configured to displace the magnetic cores 108, 107 to and from the first and second chambers 102, 103. The mechanical actuator comprises an elongate drive rod 203 extending axially through the centre of central cylinder 106. Drive rod 203 is further housed within an elongate cylinder 209, also extending axially within central cylinder 106. The actuator mechanism further comprises a piston 204, connected to the drive rod 203, the piston configured to shuttle backwards and forwards within cylinder 209. A flange 207 is connected to one end of drive rod 203 and connects to link arms 208 mounted and extending from an upper end of each column of magnets 108, 107. Accordingly, movement of piston 204 within cylinder 209 in turn provides displacement of each magnetic core 108, 107 relative to housing 100 and the respective core housing tubes 300, 301 within each chamber 102, 103.

A fluid flow inlet 205 and outlet 206 is provided at a lower end of cylinder 209 to allow an operation fluid (typically compressed air) to act against piston 204 and force drive rod 203 from cylinder 209 as illustrated in FIG. 3 via a pushing motion as opposed to a pulling action in order to maximise efficiency of the operation and the use of the drive fluid (compressed air).

Figure 4:
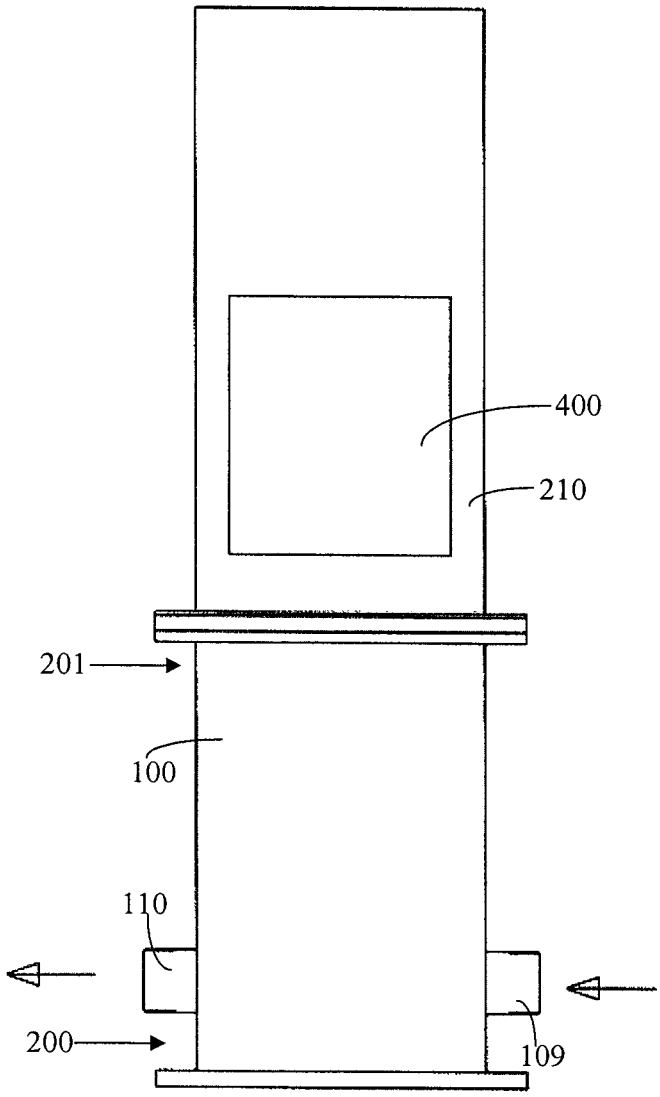
FIG. 4 illustrates schematically the external housings of the filtration apparatus of FIG. 1.

Referring to FIG. 4, the filtration apparatus further comprises an electronic control 400. According to the specific implementation, electronic control 400 comprises a programmable logic controller and is coupled electronically to the actuator mechanism to control movement of the magnetic cores 108, 107 relative to chambers 102, 103. According to an alternative implementation control 400 may be configured as software running on a PC or a printer circuit board. Means (not shown) may also be provided to enable manual operation of the drive rod 203 to allow manual displacement of the magnetic cores 108, 107 from the chambers 102, 103.

Figure 5:
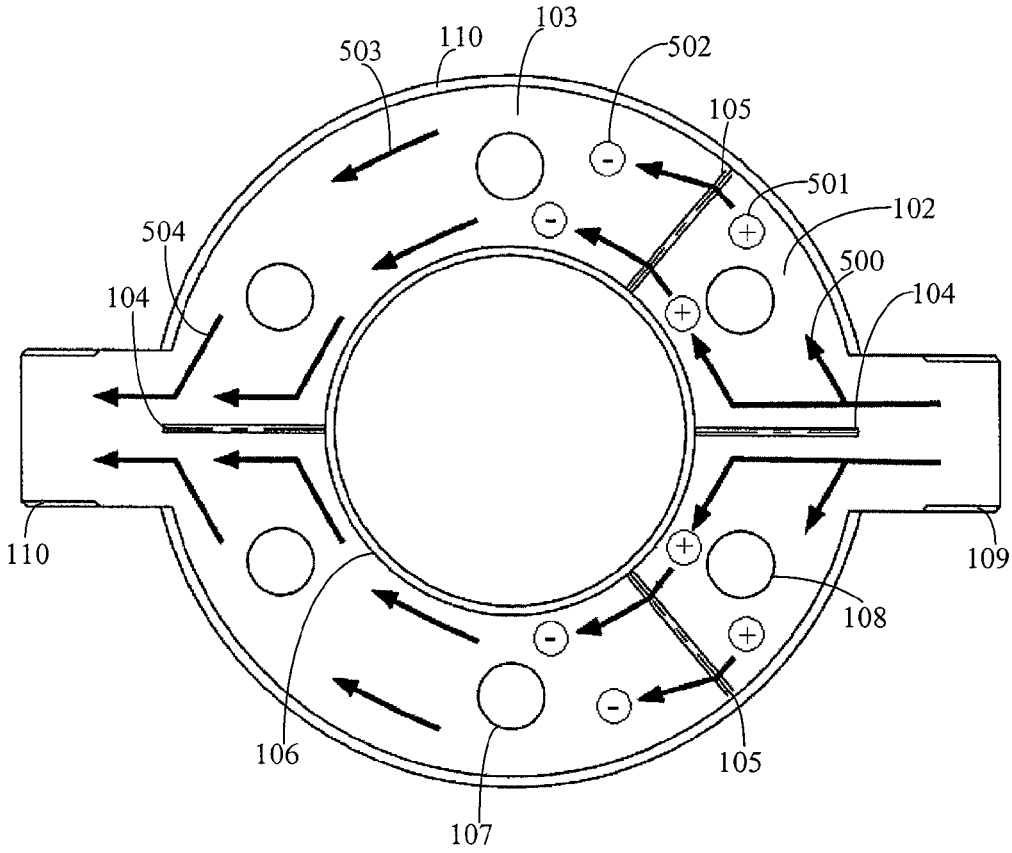
FIG. 5 illustrates a cross sectional plan view of the internal chambers and housing of the filtration apparatus of FIG. 1.
Figure 6:
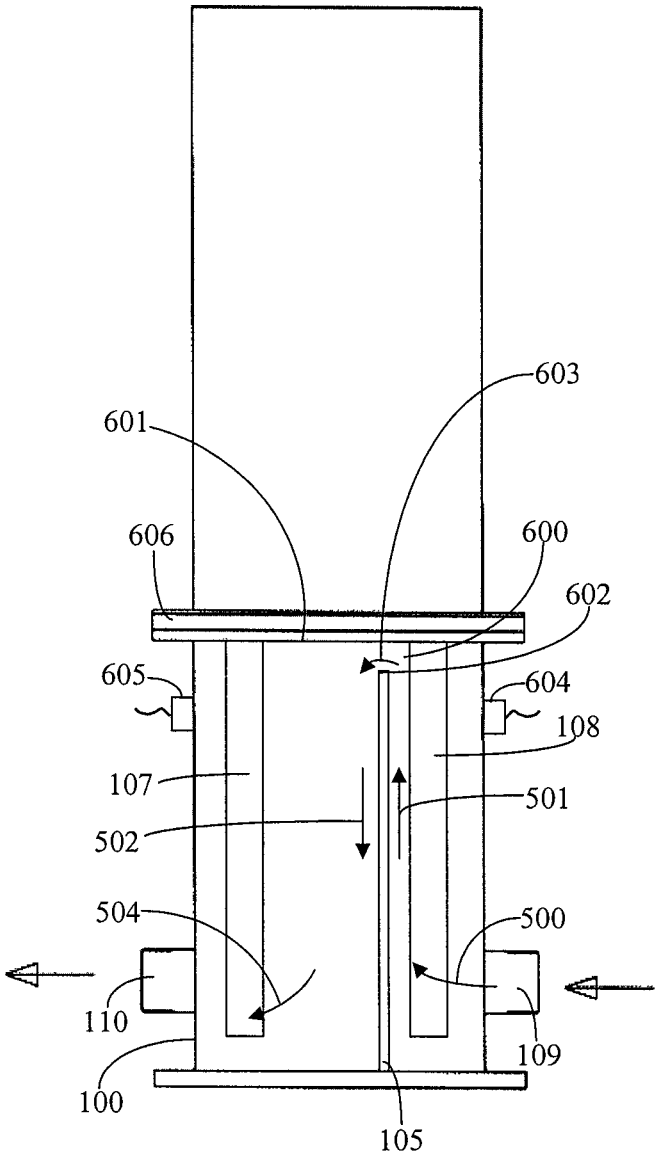
FIG. 6 illustrates the internal fluid flow path through the housing of the magnetic filtration apparatus of FIG. 4.

Referring to FIG. 5, each of the radially extending partition walls 104 bisect either the inlet 109 and outlet 110 so as to partition the flow of fluid to and from housing 100 into two fluid flow paths within chamber 101 around central cylinder 106. In use, and referring to FIGS. 5 and 6 the working fluid having a suspension of ferrous contaminant material flows into the filtration apparatus via inlet 109. The fluid flow is diverted into each of the first chambers 102 by partition wall 104 that bisects in half the internal facing aperture of inlet 109. The fluid flow 500 entering each first chamber 102 then flows in an upward direction 501 against gravity from the lower region 200 to the upper region 201 of internal chamber 102 within housing 100.

Fluid communication between the first chamber 102 and second chamber 103 is provided by a small gap 600 between an uppermost edge 602 of partition wall 105 and the downward facing surface 601 of a lid 606 that seals the upper end of internal chamber 101. That is, internal partition wall 105 extends from base 111 to a region just below lid 606 such that fluid 603 is capable of flowing over the upper edge 602 of the partition 105. As the fluid 501 flows passed the elongate magnetic core 108, the magnetic field created by the core acts to entrap the ferrous contaminant material around the elongate tube 300 as a pre-filtration step.

The pre-filtered fluid then flows 603 into second chamber 103 and in a downward direction 502 passed the magnetic core 107. Further contaminant material, not entrapped by magnetic core 108 is then captured by a final filtration step as the fluid flows through the magnetic field generated by the magnetic cores 107. The fully filtered fluid 504 then flows out 504 of the second chamber 103 and housing 100 via outlet 110. This outflow of fluid 504 is guided by partition wall 104 that bisects the internal facing aperture of outlet 110. As illustrated with reference to FIG. 5, the fluid flow through the filtration apparatus is divided into two fluid paths around central cylinder 106.

In order to optimise both filtration and purging of the filtration apparatus the fluid is directed to flow in an upward direction against gravity within first chamber 102 and a second opposed direction with the gravitational force along the length of chamber 103. By configuration of the relative dimensions and positioning of international partition walls 105, the fluid flow speed through first chamber 102 is at least double that of the flow rate through second chamber 103.

Furthermore, filtration is maximised by increasing the exposure of the working fluid to the magnetic field created by the magnetic cores 108, 107 by directing the fluid to flow axially along the cores 108, 107 in at least two directions.

With the magnets positioned within housing 100 as illustrated in FIG. 2 the filtration apparatus is configured to filter contaminant material from the working fluid. Prior to saturation of the filter with contaminant it is necessary to purge or clean the filter to remove the deposited material to begin again the filtering operation. The purging state is illustrated in FIG. 3 with the magnetic cores 108, 107 withdrawn from their respective housing tubes 300, 301 by the actuator mechanism. With the cores in the withdrawn state, the contaminant material entrapped about tubes 300, 301 is washed from these tubes by the constant flow of fluid through the chamber 101. Accordingly, the dimensions of gap 600 are important to determine the relative fluid flow rates through the first and second chambers 102, 103 such that the flow rate is not too fast so that the contaminant material bypasses the magnetic fields when the magnetic cores are positioned in use (FIG. 2) and the flow rate is sufficient to allow purging of the contaminant material when the magnetic cores 108, 107 are withdrawn (FIG. 3). According to specific implementations means (not shown) may be provided to enable a user to adjust the relative position of partition walls 105 to selectively adjust the dimensions of gap 600 and the relative internal volume sizes of first and second chambers 102, 103. Adjustment of these parameters may therefore provide for adjustment of the fluid flow rate through the filtration device and accordingly the time interval of operation between the necessary intermediate purging process and the time take to purge, being dependent upon the fluid flow rate.

Suitable valves (not shown), in particular electromagnetic valves, may be coupled to control 400 such that fluid flow downstream of the filtration apparatus can be diverted during the purging stage of FIG. 3. In particular, the working fluid that is used to purge the apparatus may be diverted into a storage tank for subsequent treatment of the contaminant slurry to facilitate subsequent disposal. Control 400 is configured to synchronise actuation of the downstream diverter valves (not shown) and the actuation mechanism of the magnetic cores 108, 107.

Control 400 may further comprise saturation sensors 604, 605 positioned in close proximity to the respective chambers 102, 103. Via sensors 604, 605 and control 400, the actuation mechanism may be prematurely triggered prior to the predetermined time interval so as to avoid undesirable blockage of the fluid flow path through the apparatus. Additionally, a manual override facility of the actuation mechanism may also be provided via a suitable manual override (not shown) connected to each magnetic core 108, 107.

The invention claimed is:

1. Magnetic filtration apparatus to separate contaminant material from a fluid, said apparatus comprising:

a housing to provide containment of a fluid flowing through the apparatus, the housing having a fluid inlet and a fluid outlet;

a first elongate chamber within the housing, the first elongate chamber in fluid communication with the inlet to allow fluid to enter the first elongate chamber substantially towards a first end of the first elongate chamber;

a first elongate magnetic core extending axially within the first elongate chamber such that a magnetic field generated by the first elongate magnetic core is created in the fluid flow path to entrap contaminant material as it flows passed the first elongate magnetic core;

a second elongate chamber within the housing, the second elongate chamber in fluid communication with the outlet to allow the fluid to exit the second elongate chamber substantially towards a first end of the second elongate chamber;

a second elongate magnetic core extending axially within the second elongate chamber such that a magnetic field generated by the second elongate magnetic core is created in the fluid flow path to entrap contaminant material as it flows passed the second elongate magnetic core;

a passageway connecting the first and second elongate chambers in internal fluid communication towards their respective second ends such that the fluid is directed to flow from the inlet passed substantially the full length of the first elongate magnetic core in a first direction, through the passageway, passed substantially the full length of the second elongate magnetic core in a second direction opposed to the first direction to the outlet; and wherein each of the first and second elongate magnetic cores is housed within a respective elongate tube positioned within the first and second elongate chambers; and wherein a volume of the first elongate chamber is less than a volume of the second elongate chamber such that a fluid flow speed in the first elongate chamber is greater than a fluid flow speed in the second elongate chamber.

2. The apparatus as claimed in claim 1 wherein the housing is sub-divided into two first elongate chambers and two second elongate chambers.

3. The apparatus as claimed in claim 2 wherein one first elongate magnetic core is positioned within each of the two first elongate chambers and two second elongate magnetic cores are positioned within each of the two second elongate chambers.

4. The apparatus as claimed in claim 2 wherein two elongate magnetic cores are positioned within each of the two first elongate chambers and eight second elongate magnetic cores are positioned within each of the two second elongate chambers.

5. The apparatus as claimed in claim 1 further comprising an actuation mechanism connected to each of the first and second magnetic cores and configured to displace each elongate magnetic core axially with respect to the first and second elongate chambers and each respective elongate tube such that each one of the first and second elongate magnetic cores is capable of being withdrawn and inserted axially from each respective elongate tube.

6. The apparatus as claimed in claim 5 wherein the actuation mechanism comprises a piston, a cylinder and a drive rod connected to the piston.

7. The apparatus as claimed in claim 6 wherein the actuation mechanism comprises a fluid flow inlet and outlet at the piston side of the cylinder such that fluid flowing into the cylinder via said inlet is configured to push the cylinder and the drive rod axially along the length of the cylinder.

8. The apparatus as claimed in claim 7 wherein the actuation mechanism comprises means to allow pneumatic actuation.

9. The apparatus as claimed in claim 8 wherein each of the first and second elongate magnetic cores is connected to the drive rod such that as the drive rod is pushed along the length of the cylinder, each of the first and second elongate magnetic cores is withdrawn from each respective elongate tube.

10. The apparatus as claimed in claim 1 wherein the first and second elongate chambers are defined by a plurality of partition walls extending internally within the housing.

11. The apparatus as claimed in claim 10 wherein the passageway is defined by a gap in at least one of the partition walls separating the first and second elongate chambers, the gap positioned towards each respective second end of the first and second elongate chambers.

12. The apparatus as claimed in claim 1 further comprising an electronic control means coupled to an actuation mechanism to control displacement of the first and second elongate magnetic cores relative to the respective first and second elongate chambers.

13. The apparatus as claimed in claim 1 further comprising at least one contaminant saturation sensor to monitor the amount of contaminant material entrapped by the first and second elongate magnetic cores.

14. The apparatus as claimed in claim 1 wherein when the apparatus is orientated in normal use, the direction of the fluid flow passed the first elongate magnetic core in the first elongate chamber is opposed to gravity and the direction of the fluid flow in the second elongate chamber passed the second elongate magnetic core is in the same direction as the gravitational force.

15. The apparatus as claimed in claim 1 wherein the volume of the first elongate chamber is substantially half the volume of the second elongate chamber.

16. A method of separating contaminant from a fluid using magnetic filtration apparatus, the method comprising:

passing a fluid for filtration through a housing having an inlet and an outlet;

directing the fluid to flow lengthwise through a first elongate chamber within the housing from the inlet, wherein the inlet is positioned towards one end of the first elongate chamber;

the fluid flowing through a magnetic field created within the first elongate chamber by an first elongate magnetic core extending axially within the first elongate chamber, the magnetic field acting to entrap contaminant material from the fluid;

directing the fluid to flow lengthwise through a second elongate chamber within the housing to the outlet, wherein the outlet is positioned towards one end of the second elongate chamber;

the fluid flowing through a magnetic field created within the second elongate chamber by a second elongate magnetic core extending axially within the second elongate chamber, the magnetic field acting to entrap contaminant material from the fluid;

directing the fluid through a passageway connecting the first and second elongate chambers in internal fluid communication at the respective second ends of the first and second elongate chambers such that the fluid flows from the inlet passed substantially the full length of the first elongate magnetic core in a first direction, through the passageway, passed substantially the full length of the second elongate magnetic core in a second direction opposed to the first direction to the outlet; and wherein each of the first and second elongate magnetic cores is housed within a respective elongate tube positioned within the first and second elongate chambers; and wherein a volume of the first elongate chamber is less than a volume of the second elongate chamber such that a fluid flow speed in the first elongate chamber is greater than a fluid flow speed in the second elongate chamber.

17. The method as claimed in claim 16 further comprising withdrawing the first and second elongate magnetic cores axially from the respective first and second elongate chambers using an actuation mechanism.

18. The method as claimed in claim 17 wherein the actuation mechanism comprises a piston, a cylinder and a drive rod connected to the piston.

19. The method as claimed in claim 16 comprising removing deposited contaminant materials from around each of the first and second elongate magnetic cores by allowing fluid to flow through the first and second elongate chambers with the first and second elongate magnetic cores withdrawn from the first and second elongate chambers.

20. The method as claimed in claim 19 further comprising diverting fluid flow downstream of the apparatus to collect contaminant material washed from around the first and second elongate magnetic cores.

21. The method as claimed in claim 20 further comprising reintroducing the first and second elongate magnetic cores into the respective first and second elongate chambers using the actuation mechanism.

22. The method as claimed in claim 21 further comprising automating and controlling the steps of withdrawing the first and second elongate magnetic cores from the respective first and second elongate chambers and reintroducing the first and second magnetic elongate cores at the first and second elongate chambers using a control means.

23. The method as claimed in claim 22 wherein the control means is a programmable logic controller.

24. The method as claimed in claim 22 wherein the control means is software running on a PC.

25. The method as claimed in claim 16 wherein the speed of fluid flow through the first elongate chamber is at least double the fluid flow speed in the second elongate chamber.

* * * * *